US009592614B2

(12) United States Patent
Oosterhoff et al.

(10) Patent No.: US 9,592,614 B2
(45) Date of Patent: Mar. 14, 2017

(54) SHAVING HEAD WITH PIVOTABLE SHAVING UNIT

(71) Applicant: KONINKLIJKE PHILIPS N.V., Eindhoven (NL)

(72) Inventors: Hans Oosterhoff, Eindhoven (NL); Jelte Steur, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/768,486

(22) PCT Filed: May 7, 2014

(86) PCT No.: PCT/EP2014/059302
§ 371 (c)(1),
(2) Date: Aug. 18, 2015

(87) PCT Pub. No.: WO2014/184065
PCT Pub. Date: Nov. 20, 2014

(65) Prior Publication Data

US 2016/0052153 A1 Feb. 25, 2016

(30) Foreign Application Priority Data

May 16, 2013 (EP) ..... 13167964

(51) Int. Cl.
*B26B 19/14* (2006.01)

(52) U.S. Cl.
CPC ..... *B26B 19/146* (2013.01); *B26B 19/145* (2013.01)

(58) Field of Classification Search
CPC ..... B26B 19/14; B26B 19/141; B26B 19/143; B26B 19/145; B26B 19/146; B26B 19/386
(Continued)

(56) References Cited

U.S. PATENT DOCUMENTS 3,715,803 A * 2/1973 Tyler ..... B26B 19/145 30/43.5
4,168,570 A * 9/1979 Bakker ..... B26B 19/14 30/43.6
(Continued)

FOREIGN PATENT DOCUMENTS

EP 0162277 A1 * 11/1985
EP 0375949 A2 7/1990
(Continued)

OTHER PUBLICATIONS

Sky Mall® Summer 2007, Norelco arcitec Electric Shaver, p. 110.*

*Primary Examiner* — Jason Daniel Prone

(57) ABSTRACT

A shaving head having a shaving unit that includes a shaving unit frame with a skin contacting face, and at least two cutting units each having an external cutting member and an internal cutting member A pivot structure includes inter-engaging portions of a support structure and the shaving unit that enable the shaving unit to pivot relative to the support structure. Each internal cutting member is rotatable by a central driving member via a separate cutter driving member, the central driving member being configured to transmit a driving force to each cutter driving member in a transmission location. The pivot structure is located in an internal area of the shaving head between the skin contacting face, the cutter driving members and the transmission locations. The pivot structure further enables the central driving member and the cutter driving members to pivot together with the shaving unit relative to the support structure.

19 Claims, 7 Drawing Sheets

(58) Field of Classification Search
USPC ..... 30/43.3–43.92
See application file for complete search history.

(56) References Cited

U.S. PATENT DOCUMENTS

| | | | | |
|---|---|---|---|---|
| 4,649,642 | A * | 3/1987 | Nagasaki | B26B 19/06 30/43.92 |
| 5,577,324 | A | 11/1996 | Tanaka | |
| 5,625,950 | A * | 5/1997 | Sterk | B26B 19/145 30/43.6 |
| 6,722,038 | B2 | 4/2004 | Visman | |
| 7,472,483 | B2 * | 1/2009 | Beugels | B26B 19/063 30/43.4 |
| 7,584,541 | B2 * | 9/2009 | Uchiyama | B26B 19/145 30/43.4 |
| 7,930,828 | B2 * | 4/2011 | Brada | B26B 19/14 30/43.4 |
| 8,261,452 | B2 * | 9/2012 | Westerhof | B26B 19/14 30/43.4 |
| 8,296,954 | B2 * | 10/2012 | Schneider | B26B 19/14 30/43.4 |
| 8,336,211 | B2 * | 12/2012 | De Wit | B26B 19/141 30/43.4 |
| 8,393,082 | B2 * | 3/2013 | Shimizu | B26B 19/14 30/43.5 |
| 8,844,141 | B2 * | 9/2014 | Van Der Borst | B26B 19/14 30/43.4 |
| 9,009,978 | B2 * | 4/2015 | Schneider | B26B 19/14 30/43.4 |
| 9,180,598 | B2 * | 11/2015 | Van Der Meer | B26B 19/14 30/43.6 |
| 9,216,513 | B2 * | 12/2015 | Brada | B26B 19/14 30/43.6 |
| 2004/0128834 | A1 * | 7/2004 | Royle | B26B 19/048 30/43.92 |
| 2004/0231160 | A1 * | 11/2004 | Shiba | B26B 19/046 30/43.92 |
| 2004/0237310 | A1 * | 12/2004 | Shiba | B26B 19/048 30/43.92 |
| 2007/0124936 | A1 * | 6/2007 | Okabe | B26B 19/14 30/43.6 |
| 2007/0277379 | A1 * | 12/2007 | Okabe | B26B 19/14 30/43.92 |
| 2008/0034591 | A1 * | 2/2008 | Fung | B26B 19/02 30/43.92 |
| 2009/0165305 | A1 * | 7/2009 | Kraus | B26B 19/282 30/43.7 |
| 2010/0000092 | A1 | 1/2010 | Schneider | |
| 2010/0058594 | A1 | 3/2010 | Westerhof | |
| 2011/0030220 | A1 | 2/2011 | Shimizu | |
| 2011/0173815 | A1 | 7/2011 | Koike | |
| 2012/0227266 | A1 * | 9/2012 | Meijer | B26B 19/14 30/41.6 |
| 2015/0013167 | A1 * | 1/2015 | Shen | B26B 19/14 30/43.6 |
| 2015/0224654 | A1 * | 8/2015 | Steur | B26B 19/145 30/43.6 |
| 2016/0199987 | A1 * | 7/2016 | Brada | B26B 19/14 30/43.6 |

FOREIGN PATENT DOCUMENTS

| | | | |
|---|---|---|---|
| EP | 2281670 | A1 | 2/2011 |
| WO | 2006067713 | A1 | 6/2006 |
| WO | 2010034175 | A1 | 4/2010 |
| WO | WO 2014184065 | A1 * | 11/2014 |
| WO | WO 2015169625 | A1 * | 11/2015 |

* cited by examiner

SHAVING HEAD WITH PIVOTABLE SHAVING UNIT

This application is the U.S. National Phase application under 35 U.S.C. §371 of International Application No. PCT/EP2014/059302, filed on May 7, 2014, which claims the benefit of European Application No. 13167964.9 filed on May 16, 2013.

BACKGROUND OF THE INVENTION

1. Field of the Invention

The present invention relates to a shaving head for a shaving apparatus of the rotary type and in particular to a shaving head having a pivotable shaving unit. The invention also relates to a shaving apparatus incorporating such a shaving head.

2. Description of the Related Art

Electric shavers are frequently used consumer items which generally comprise an assembly of moving and stationary cutting elements that interact to cut the hairs at the surface of a user's skin. In the case of rotary electric shavers, one or more cutting units, each comprising a rotary cutter and a cap, co-operate to cut the hairs. The cap contacts the skin and the cutter is driven by a motor located within the body of the shaver. For greater comfort and effective shaving, the portions of the shaver that contact the skin of the user should be able to move or pivot relative to the body of the shaver to follow the skin surface. This requires a degree of flexibility of the drive train between the motor and the cutter. In general, the more contact the shaving cap makes with the skin, the closer and quicker the shave will be. Most shavers therefore allow some freedom of movement of the caps with respect to the body of the shaver, so that the caps can follow the contours of the user's skin.

In current rotary shavers, the above-described movement or flexibility is achieved at a number of possible locations. Firstly, the caps themselves may be resiliently mounted to move up and down and tilt within a cap carrier. Secondly, the cap carrier may be mounted to float or tilt with respect to the body of the shaver. A third location of movement may be found between the shaving unit and the handle or body of the shaver. In certain models, the shaving unit or head of the shaver may be mounted to the body at a neck that can pivot forwards and backwards and/or from side to side. A given shaver design may incorporate some or all of these possible degrees of freedom. A shaving device is known from US patent publication U.S. Pat. No. 5,577,324 in which a shaving head carries three cutting units mounted in an outer cutter frame. A driving mechanism is provided within the shaver body and comprises a main gear engaged with three transmission gears. The shaving head is mounted to pivot about a shaving head supporting member with respect to the shaver body and the transmission gears.

Although the existing designs offer considerable flexibility to the user, it would be desirable to provide a shaving head construction which still further enhances the ability to follow the contours of the skin while allowing for a simple and robust construction.

BRIEF SUMMARY OF THE INVENTION

According to the invention, there is provided a shaving head for a shaving apparatus comprising a main housing accommodating a motor, the shaving head comprising: a support structure including a coupling structure for coupling the shaving head to the main housing of the shaving apparatus;

a shaving unit comprising a shaving unit frame and a skin contacting face and at least two cutting units each having an external cutting member and an internal cutting member which is rotatable relative to the external cutting member; a pivot structure for allowing the shaving unit to pivot relative to the support structure; a central driving member arranged to be driven by the motor when the shaving head is coupled to the main housing; wherein each internal cutting member is rotatable by the central driving member via a separate cutter driving member, the central driving member transmitting a driving force to each cutter driving member in a transmission location; and wherein the pivot structure is located in an internal area of the shaving head located between the skin contacting face, the cutter driving members and the transmission locations of the central driving member. The central driving member and the cutter driving members each have a bearing which is connected to the shaving unit frame to allow the central driving member and the cutter driving members to pivot together with the shaving unit relative to the support structure.

By arranging the central driving member and the cutter driving members in this manner, they do not need to be connected to the shaving unit in a manner allowing them to pivot relative to the shaving unit. Only the central driving member needs to have a connection to the motor, allowing pivoting of the central driving member relative to the main housing, to compensate for the relative pivoting of the shaving unit with respect to the main housing. This pivoting connection may be provided by a flexible coupling between the central driving member and the motor. In this manner, the pivoting freedom of the shaving unit relative to the main housing, in particular the allowable maximum pivoting angle of the shaving unit relative to the main housing, is less affected by the necessary connection of the central driving member and the cutter driving members to the motor. Furthermore, by providing the pivot structure at a position above the central driving member and closer to the skin contacting face of the shaving unit, an improved geometry is achieved allowing better pivoting of the shaving head to follow the contours of the skin during shaving without undesired tilting. In conventional shavers, pivoting of the shaving head or shaving unit usually takes place about a pivot point or axis that is at or below the central driving member, i.e. closer to the motor. According to the present invention, the pivot point or axis is moved closer to the skin contacting face and may, for example, be located midway between the central driving member and the skin contacting face or even closer to the skin contacting face. It will be understood that in some configurations the skin contacting face of the shaving unit may not be flat. For the purpose of determination, the skin contacting face may be considered as the plane of engagement when the skin contacting face is pressed against a flat surface. In the case of a single pivot axis, the pivot axis preferably lies parallel to the skin contacting face. In a more preferred embodiment, the shaving unit may pivot about two axes, preferably orthogonal axes, both of which lie parallel to the skin contacting face. Alternatively, the shaving unit may pivot universally about multiple axes lying parallel to the face.

In a preferred embodiment, the bearing of the central driving member comprises an axle extending from the shaving unit frame in a direction away from the skin contacting face, and the central driving member is mounted for rotation on the axle. In general, the axle will be aligned with an axis normal to the pivot axis or, in the case of two pivot axes, orthogonally thereto.

Preferably, the pivot structure defines a pivot point or pivot axis for the shaving unit relative to the support structure that is distanced from the skin contacting face by less than 12 mm, more preferably less than 10 mm, and most preferably less than 8 mm. As a general rule, it has been found that a relation exists between the distance from a pivot axis or pivot point to the leading edge of the skin contacting face of a shaver and the distance the pivot axis or pivot point is situated below the skin contacting face. For a stable geometry, a ratio of 3:1 should be maintained between these distances in order to prevent tipping of the pivotable shaving unit under the influence of friction forces between the skin and the cutting units when moving over the skin. By reducing the distance between the pivot axis and the skin contacting face, said ratio between said two distances is increased. In addition, other design choices are enabled, including for example a reduction of the pivoting stiffness of the shaving head of the shaving apparatus. At present, pivoting of a shaving head having two cutting units has usually been limited to the lengthwise direction, i.e. with the pivot axis being arranged transversally between the two external cutting members. As a result of the enhanced pivoting characteristics of the shaving head of the present invention, even shaving heads having two cutting units may be allowed to pivot about two axes.

While the distance from the pivot point or pivot axis to the skin contacting face may be determined in absolute terms, it may also be convenient to define it in relative terms. As mentioned above, an optimal configuration is achieved when the ratio of this distance to the lateral distance to the edge of the skin contacting face in the direction of motion of the shaving head over the skin is less than 1:3. Significant advantages may be achieved when said ratio is less than 1:2. More precisely, the distance may be determined in relation to the working diameter of an internal cutting member, as this will often define the geometry of the skin contacting face. Preferably, the distance from the pivot point or pivot axis to the skin contacting face is less than the diameter of an internal cutting member, more preferably less than half of this diameter.

In a further embodiment of the invention, the shaving head is further provided with a biasing arrangement acting on the shaving unit to pivot the shaving unit to a neutral position. The neutral position may be a central position in which the shaving unit is midway between its end pivotal positions. This may also correspond to a position in which the central driving member is axially aligned with the support structure and/or the motor drive shaft. Preferably, the biasing arrangement comprises a bellows structure encircling the support structure and acting between the shaving unit and the support structure. The bellows may generally be conical, with a widest end of the conical bellows engaging the shaving unit frame and a narrowest end of the conical bellows engaging around the support structure. Other biasing arrangements may be provided to take up slack in the various pivots.

In a still further embodiment of the invention, the position of the pivot point or pivot axis may be defined in terms of the distance between the centre of gravity of the pivotable shaving unit and the skin contacting face. Preferably, the pivot point or pivot axis is located at a distance from the skin contacting face that is less than or equal to the distance between said centre of gravity and the skin contacting face. Such a configuration allows the shaving unit to adopt a more stable position during shaving, and with such a configuration less biasing force is required to keep the shaving unit in a neutral position. It has in fact been determined that a biasing force that is four times less than that used in conventional geometries may be sufficient to keep the shaving unit in the neutral position.

In a further embodiment of the invention, the pivot structure comprises cooperating spherical bearing surfaces provided on the shaving unit and on the support structure and arranged in said internal area of the shaving head to allow pivoting of the shaving unit about any axis parallel to the skin contacting face of the shaving unit. The spherical bearing surfaces may be provided on a bearing ball and on a bearing socket, wherein either the bearing ball or the bearing socket is provided on the support structure. It will be understood that the bearing surfaces need not be entirely spherical, but may comprise surface sections forming part of a sphere.

In a further embodiment, the pivot structure comprises a so-called Visman coupling element provided on either the shaving unit or the support structure and arranged in said internal area of the shaving head. Such Visman coupling elements are generally well known, e.g. for use in flexible couplings between drive spindles and cutting units of rotary shavers, and need not be further explained here. They are understood to encompass all boss-cavity-type connections that allow a transfer of torque along a first axis, while permitting pivotal movement between boss and cavity about two other axes orthogonal to said first axis. Such a Visman coupling element may have a geometry as disclosed in U.S. Pat. No. 6,722,038, the contents of which are incorporated in their entirety herein by reference. This configuration is preferably applicable to shaving units having three cutting units, but it will be understood that it can also be applied to shaving units have another number of cutting units. The Visman coupling element may have a triangular cross-section or any other non-circular cross-section that prevents rotation of the shaving unit with respect to the support structure.

In another embodiment, the pivot structure comprises a living hinge formed between the shaving unit and the support structure and arranged in said internal area of the shaving head. More particularly, the living hinge may engage between the shaving unit frame and a central portion of the support structure. The shaving unit and the support structure may be separable from each other, but the living hinge may remain connected to one or the other of these components. In the present context, a living hinge is intended to include any flexible element that permits pivoting about first or first and second axes while allowing transmission of torque and force along a third perpendicular axis. Living hinges are conventionally formed of plastic material, but it is understood that a flexible wire, cable or strip could also fulfill this function.

In an alternative embodiment, the shaving unit has two cutting units and the pivot structure comprises cooperating cylindrical bearing surfaces provided on the shaving unit and on the support structure and arranged in said internal area of the shaving head to allow pivoting of the shaving unit about just one axis. The cylindrical bearing surface may be aligned transversally between the cutting units.

In a still further embodiment, the pivot structure comprises a Cardan-type joint having two orthogonal pivot axes. In this embodiment, the Cardan-type joint may also carry the axle on which the central driving member is mounted, wherein the axle is oriented orthogonally to the pivot axes of the joint.

In a further embodiment, the shaving unit and the support structure comprise guides to prevent rotation of the shaving unit about an axis of the support structure extending perpendicularly to the skin contacting face. The guides may be integral with the pivot structure. This may be realized by using a Visman coupling element, which allows pivoting about two pivot axes while blocking rotation about a third axis extending perpendicularly to the two pivot axes. More preferably, the guides are located separate from the pivot structure e.g. in radially outward positions with respect to the centre of the shaving unit and a central axis of the support structure. It will be understood by the skilled person that, in order to reduce friction during the pivoting motion about the pivot axis, the bearing surfaces of the pivot structure should be in radial positions close to the pivot axis. For the purpose of preventing rotation of the shaving unit about the axis of the support structure, the guides should be at a radially larger distance from the pivot axis to reduce wear.

In a further embodiment of the invention, the shaving unit and the support structure comprise abutments to prevent pivoting of the shaving unit relative to the support structure beyond a given pivot angle. Preferably, these abutments are provided on robust elements that can absorb shocks e.g. caused by dropping the shaving apparatus. They should preferably be located as far from the pivot structure as possible. In an embodiment, the shaving unit comprises a lower housing portion having a spherical inner surface surrounding the support structure and engaging a matching outer surface portion of the support structure. In this embodiment, the spherical inner surface of the lower housing portion of the shaving unit and the matching outer surface portion of the support structure co-operate to keep the mutually pivoting portions of the shaving head in mutual engagement. The lower housing portion may have an opening for allowing passage of the support structure, and co-operating abutments may be formed on the support structure and on the lower housing portion, in particular on an edge portion of the opening of the lower housing portion. As a result of the position of the pivot point or pivot axis close to the skin contacting face of the shaving unit, the distance of the pivot point or pivot axis to the abutments is relatively large, leading to robust abutments. Alternatively or additionally, an abutment may be provided on a part of the main housing of the shaving apparatus for co-operation with the abutment on the support structure.

In a most preferred embodiment of the invention, the support structure comprises a support tube carrying the coupling structure, and a pivot frame mounted to the support tube and carrying a stationary part of the pivot structure. In this embodiment, the central driving member may be driven by the motor via a driving spindle arranged in the support tube, preferably via a flexible coupling between the central driving member and the driving spindle. In a further embodiment, lateral openings are formed between the support tube and the pivot frame, and the central driving member is operatively in engagement with each cutter driving member through a respective one of the lateral openings. In an embodiment of a shaving head with three cutting units, at least three such lateral openings will be required, providing engagement of the central driving member with the cutter driving members of the three internal cutting members. In general, the lateral openings provide access to the interior space of the support tube In a further embodiment, the pivot frame comprises a central portion carrying the stationary part of the pivot structure, wherein said central portion is connected to the support tube via lateral arms, and wherein the lateral openings are present between the lateral arms. The pivot frame and the support tube may mechanically interengage e.g. by the use of snap connectors allowing easy installation of the central driving member into the interior space of the support tube followed by easy assembly of the pivot frame and the support tube. The pivot frame may comprise a central portion forming the stationary part of the pivot structure for pivotal engagement with a movable part of the pivot structure mounted to the shaving unit. The pivot frame is connected to the support tube via the lateral arms. For a shaving unit with three cutting units, three such lateral arms may be provided, defining three lateral openings therebetween for enabling engagement of the central driving member with each of the driving members of the three cutting units. The lateral arms may form the guides discussed above for preventing rotation of the shaving unit about an axis of the support tube extending perpendicularly to the skin contacting face. To this end, the lateral arms may be accommodated within correspondingly shaped channels of the shaving unit. The support tube and the pivot frame may also be formed as an integral single element.

The above described pivot structure of the shaving head may provide all necessary pivoting freedom to the shaving head. More preferably, however, just one of a number of degrees of pivoting freedom is included within the shaving head. Most preferably, each cutting unit comprises a carrier in which the external cutting member is mounted, wherein the carriers are pivotably mounted to the shaving unit. The carriers may constitute skin-supporting rims arranged around the cutting units. The carriers may be mounted on stub axles to pivot across a single axis about their centrelines. The external cutting members themselves may also be resiliently mounted to be depressible and pivotable relative to the carriers or, as is otherwise conventional in the art, relative to the skin contacting face.

The invention further relates to a shaving apparatus comprising a main housing and a shaving head as described above and hereinafter. The shaving head is preferably removably attached to the main housing by the coupling structure. The shaving unit can thus pivot with respect to the main housing. The coupling structure allows the shaving head to be interchanged for other accessories.

BRIEF DESCRIPTION OF THE DRAWINGS

Further features and advantages of the invention will be appreciated upon reference to the following drawings of a number of exemplary embodiments, in which.

DESCRIPTION OF ILLUSTRATIVE EMBODIMENTS

Figure 1:
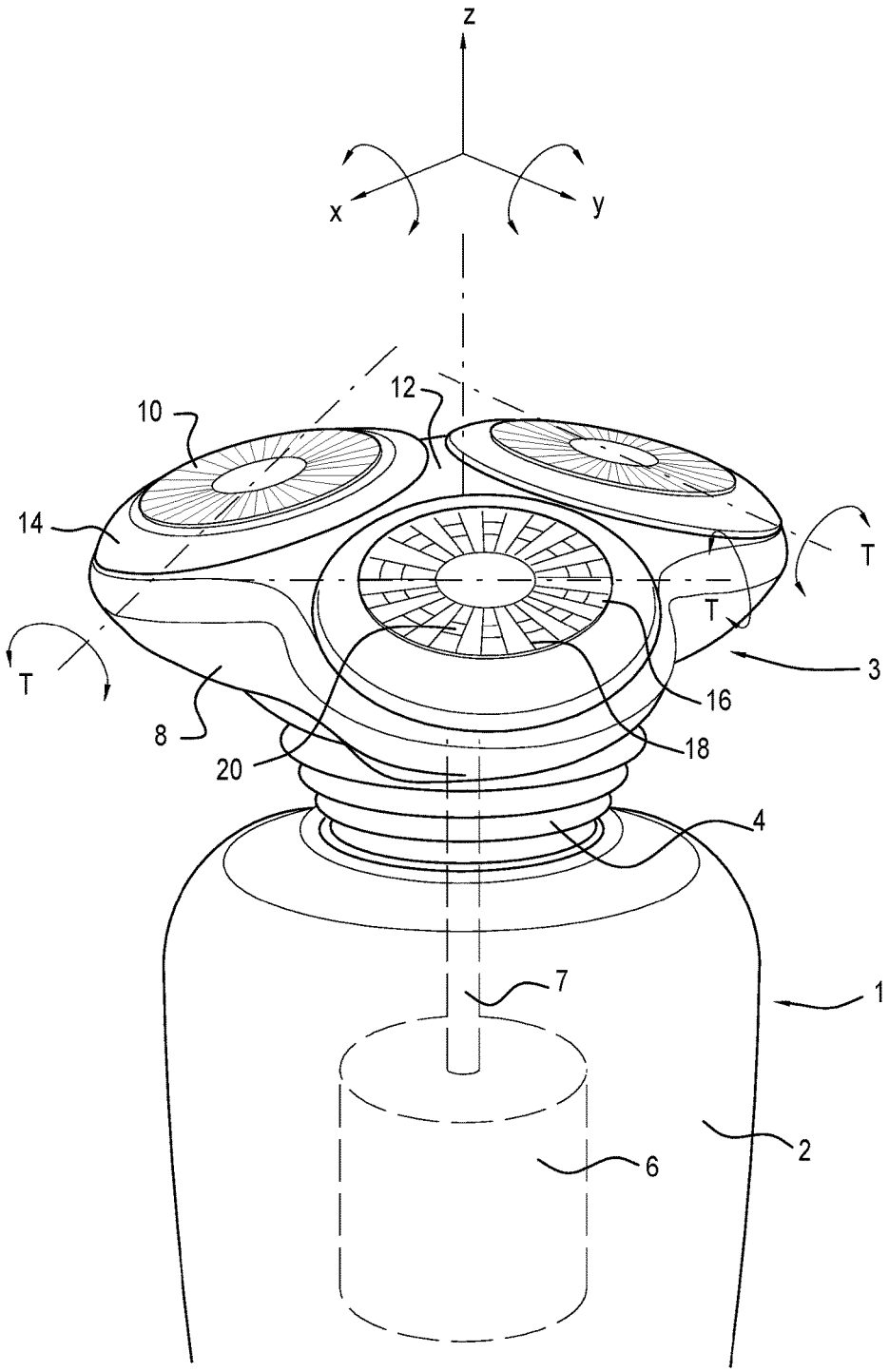
FIG. 1 shows a perspective view of a shaving apparatus according to the present invention.

FIG. 1 shows a perspective view of a shaving apparatus 1 according to the invention. The shaving apparatus 1 has a main housing 2 and a shaving head 3, connected together by a neck 4. The housing 2 accommodates motor 6 and drive shaft 7 and further components including a power supply, control electronics and the like, which are otherwise conventional and will not be described further. The shaving head 3 comprises a shaving unit 8 supporting three cutting units 10 on its skin contacting face 12. The cutting units 10 are each supported in a carrier 14. As is generally conventional, the cutting units 10 each comprise an external cutting member 16 with slots 18 for allowing hairs to pass. Inside the external cutting member 16 there is located an internal cutting member 20 which rotates to cut the hairs passing through the slots 18. As is also generally conventional, the carriers 14 are each mounted to pivot with respect to the shaving unit 8 about a transverse axis T. The external cutting members 16 are resiliently mounted with respect to the carriers 14. Furthermore, the shaving unit 8 is also arranged to pivot about both the X and Y axes that lie in the general plane of the skin contacting face 12. The shaving unit 8 is prevented from rotating around the Z axis.

Figure 2A:
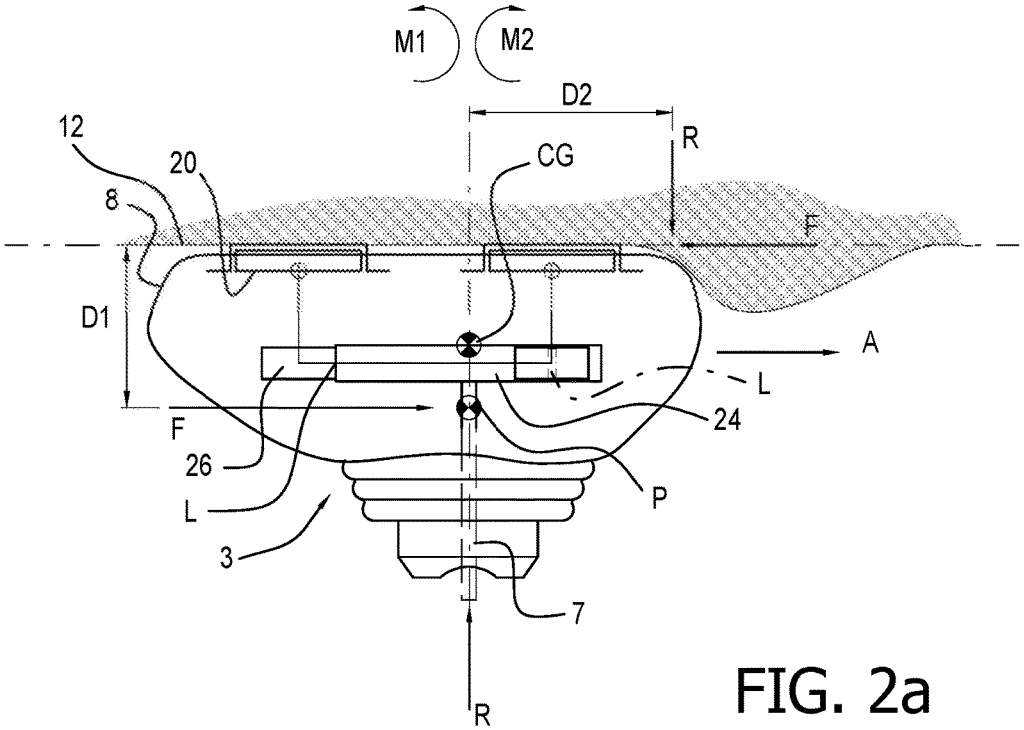
FIG. 2*a* shows a schematic view of a shaving head, illustrating conventional geometry.

FIG. 2*a* shows a schematic view of a shaving head 3, illustrating the conventional geometry of the drive train and components. Like elements are designated with corresponding reference numerals to those of FIG. 1. The drive shaft 7 from the motor engages a central driving member 24 which engages with three cutter driving members 26 for driving each of the internal cutting members 20. The pivot point P around which the shaving unit 8 can rotate is located at a position where the drive shaft 7 engages with the central driving member 24. This position is below transmission locations L in which the central driving member 24 transmits its driving force to each cutter driving members 26. The pivot point P is also located below a centre of gravity CG of the shaving unit 8. As can be seen in FIG. 2A, during a shaving motion in a direction A, a frictional force F on the skin contacting face 12 of the shaving unit 8 acts at distance D1 from the pivot point P, thereby inducing a moment M1 acting in an anti-clockwise direction. If this moment M1 exceeds a moment M2 due to the reaction force R on the skin at a distance D2 from the pivot point P, then the shaving unit 8 may tilt and be unable to adequately follow the skin contours. The distance D2 is determined by the configuration of the shaver unit 8 and generally corresponds to the distance between the pivot point P and the edge of the skin contacting face 12 in the direction A of the shaving motion. It will also be understood that in the depicted position of the pivot point P, being below the centre of gravity CG of the shaving unit 8, the shaving unit 8 will tend to tilt in the absence of other supporting elements.

Figure 2B:
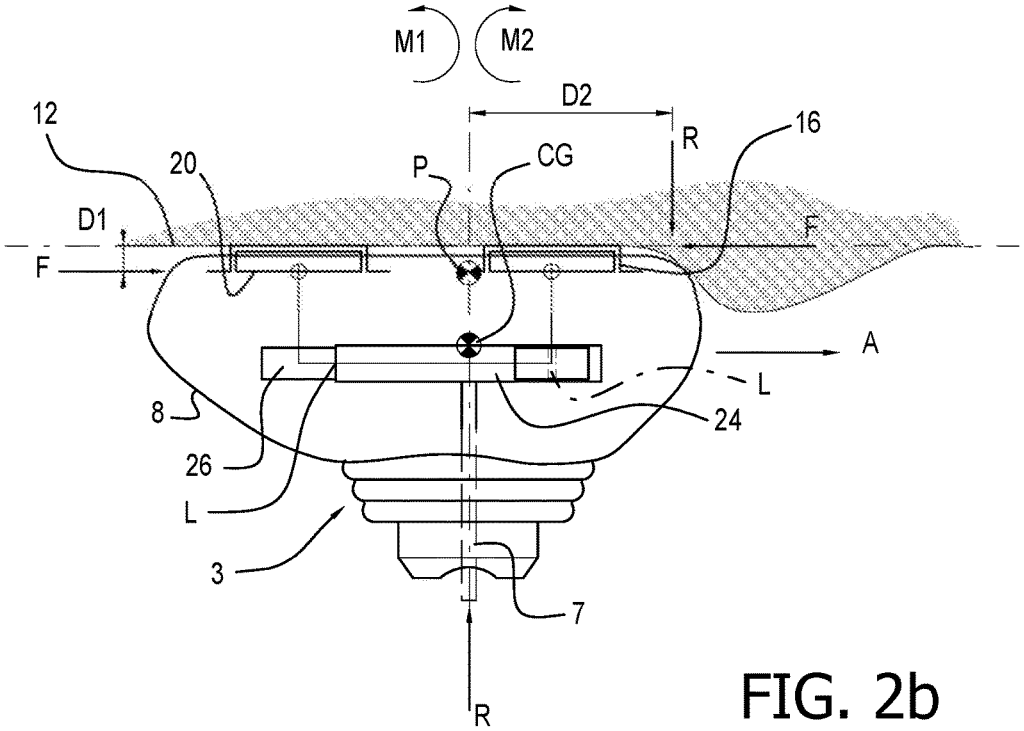
FIG. 2*b* shows a schematic view illustrating the geometry of a shaving head according to the present invention.

FIG. 2*b* shows the shaving head 3 according to the present invention, in which the geometry of the shaving head 3 is adapted to reduce the risk of undesired tilting and enhance the ability of the shaving unit 8 to follow the skin contours. According to the invention, when the shaving head 3 is coupled to the main housing 2 of the shaving apparatus, the drive shaft 7 engages with the central driving member 24, which in turn engages with the three cutter driving members 26 at the transmission locations L as shown in FIG. 2*a*. In this geometry, however, the pivot point P for the shaving head 3 is located at an elevated position close to the skin contacting face 12 and above the centre of gravity CG of the shaving unit 8. In particular, the pivot point P is now located at a position between the skin contacting face 12 and the central driving member 24, more specifically in an internal area of the shaving head 3 located between the skin contacting face 12, the cutter driving members 26 and the transmission locations L of the central driving member 24. In this embodiment it can be seen that the location of the pivot point P is at a distance D1 from the skin contacting face 12, which is less than the depth dimension of the external cutting members 16. In other words, the pivot point P lies in a plane parallel to the skin contacting face 12 that intercepts the external cutting members 16. As a result of this geometry, the frictional force F on the skin contacting face 12 of the shaving unit 8 during a shaving motion in direction A acts at a much smaller distance from the pivot point P than in the conventional geometry of FIG. 2*a*. The moment M1 induced by the frictional force F is therefore significantly smaller and the shaving unit 8 is less likely to tilt, given that the geometry of the skin contacting face 12 remains the same. Not only is the shaving unit 8 less likely to tilt, but also, during use, the reaction force R may remain closer to the pivot point P, causing the force on the skin to be better distributed. Additionally, since the pivot point P is now above the centre of gravity CG of the shaving unit 8, the shaving unit 8 is better balanced. In FIGS. 2*a* and 2*b*, the skin contacting face 12 of the shaving unit 8 is shown as being flat. It will be understood that, in actual fact, the neutral position of the external cutting members 16 and carriers 14 may lead to the skin contacting face 12 being other than flat and that it may only become flat when all of the external cutting members 16 and/or carriers 14 are aligned e.g. when pressing the skin contacting face 12 against a flat surface. As a general rule, it has been found that a ratio of 3:1 between the distance D2 from the pivot point P to the edge of the skin contacting face 12 in the direction A of the shaving movement and the distance D1 of the pivot point P below the skin contacting face 12 should be maintained in order to prevent tipping of the shaving apparatus under normal use. For this reason, pivoting of a shaving head having two cutting units is usually limited to the lengthwise direction. As a result of the enhanced geometry of the present invention, even shaving heads having two cutting units may be allowed to pivot about two axes.

Figure 3:
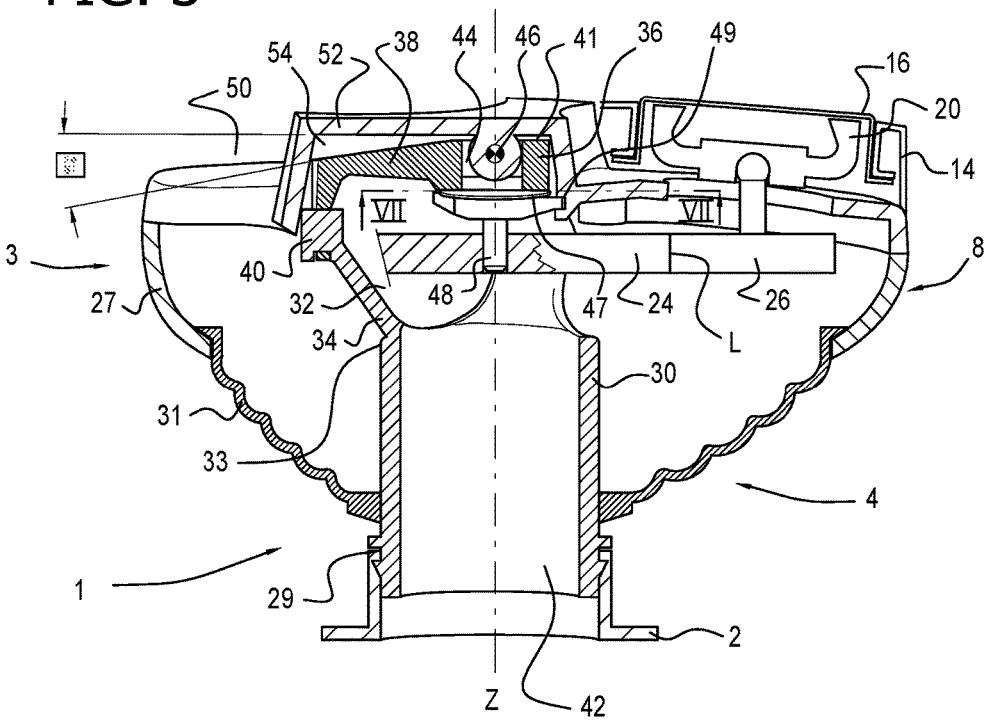
FIG. 3 shows a partially sectioned perspective view of a first embodiment of a shaving head according to the present invention.

FIG. 3 shows a first embodiment of a shaving head 3 according to the invention, illustrating a partially sectioned perspective view of the shaving head 3 in which certain components have been removed for the sake of clarity. Shaving head 3 comprises a shaving unit frame 27 and a support tube 30. The support tube 30 is located in the neck 4 of the shaving apparatus 1 and connects to main housing 2 in a snap-fit arrangement at a coupling structure 29. A flexible bellows 31 covers the support tube 30. The flexible bellows 31 is resilient and tends to bias the shaving unit 8 to the neutral position as illustrated. At the upper end of the support tube 30, lateral openings 32 are formed between lateral support tube arms 34 of the support tube 30. Mounted on the lateral support tube arms 34 is a pivot frame 36 having lateral arms 38 that engage with the lateral support tube arms 34 in a snap connection 40. The support tube 30 and the pivot frame 36 together form a support structure 33 of the shaving head 3 having an interior cavity 42.

The pivot frame 36 has a central portion 41 with a generally triangular opening 44. The triangular opening 44 forms the female bearing surface of a triangular so-called Visman coupling element. The male bearing surface of the Visman coupling element is provided by a triangular boss 46 depending on the centre of the shaving unit frame 27. The boss 46 and the triangular opening 44 form a pivot structure for allowing the shaving unit 8 to pivot relative to the support structure 33. Said pivot structure prevents relative rotation of the shaving unit frame 27 and the support structure 33 around the Z axis, but allows relative pivoting motion of the shaving unit frame 27 with respect to the support structure 33 about the X and Y axes.

Beneath the shaving unit frame 27, and attached thereto, is an axle 48 extending from the shaving unit frame 27 in a direction away from the skin contacting face 12, thereby protruding into the cavity 42 of the support structure 33. The axle 48 engages in a groove 49 of the shaving unit frame 27 and retains the pivot frame 36 in an axial position in the Z-direction relative to the boss 46. A disk spring 47 between the axle 48 and the central portion 41 of the pivot frame 36 serves to reduce play in this connection. The axle 48 also serves as a bearing for the central driving member 24, which engages with cutter driving members 26 through the lateral openings 32. As a result, the central driving member 24 has a bearing which is connected to the shaving unit frame 27, so that the central driving member 24 is allowed to pivot together with the shaving unit 8 relative to the support structure 33. The cutter driving members 26 extend upwards through the shaving unit frame 27 to engage with the internal cutting members 20 within the external cutting members 16 carried by the carriers 14. The cutter driving members 26 also have bearings connected to the shaving unit frame 27, allowing them to pivot together with the central driving member 24 and the shaving unit 8 relative to the support structure 33. These bearings have been omitted for the sake of clarity in FIG. 3. As can be seen in FIG. 3, the carriers 14 are arranged in recesses 50 formed in the upper surface of the shaving unit frame 27. The recesses 50 are separated by three ridges 52. On the underside of the shaving unit frame 27, beneath the ridges 52, three channels 54 are formed in which the lateral arms 38 are accommodated. The channels 54 intersect at the centre of the shaving unit frame 27 at the location of the boss 46. The channels 54 are generally parallel to the skin contacting face 12 of the shaving unit frame 27, while the lateral arms 38 are angled slightly downwards from the central portion 41. A diverging gap between the channels 54 and the lateral arms 38 allows the shaving unit frame 27 to pivot through an angle $\alpha$ with respect to the support structure 33.

Figure 4:
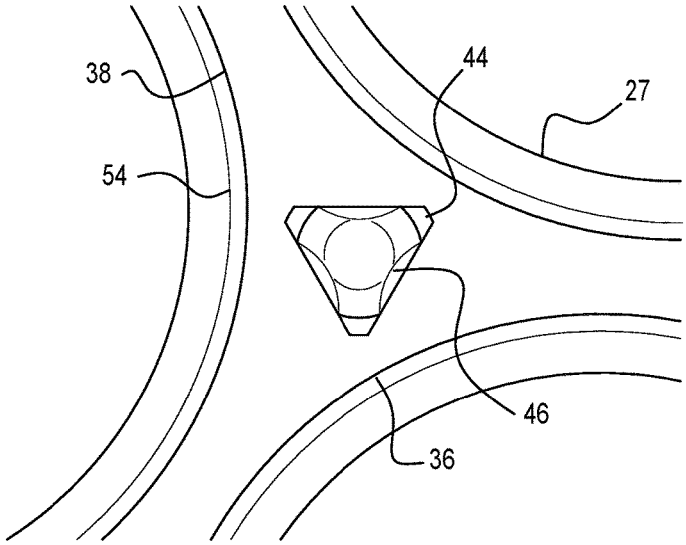
FIG. 4 is a view of the underside of the shaving unit of FIG. 3, in the direction of the arrows VI in FIG. 3.

FIG. 4 is a view of the underside of the shaving unit frame 27 of FIG. 3, in the direction of the arrows VI in FIG. 3, on a plane intersecting the pivot frame 36 in a position below the boss 46. As can be seen, the triangular boss 46 is a close fit to the triangular opening 44 and the lateral arms 38 generally correspond in shape to the channels 54. As a result of their shape, the boss 46 and triangular opening 44 prevent relative rotation of the shaving unit frame 27 and the support structure 33 around the Z axis. They however allow a relative pivoting motion of the shaving unit frame 27 with respect to the support structure 33 about the X- and Y-axis shown in FIG. 1. The same applies to the lateral arms 38 and the channels 54.

Figure 5:
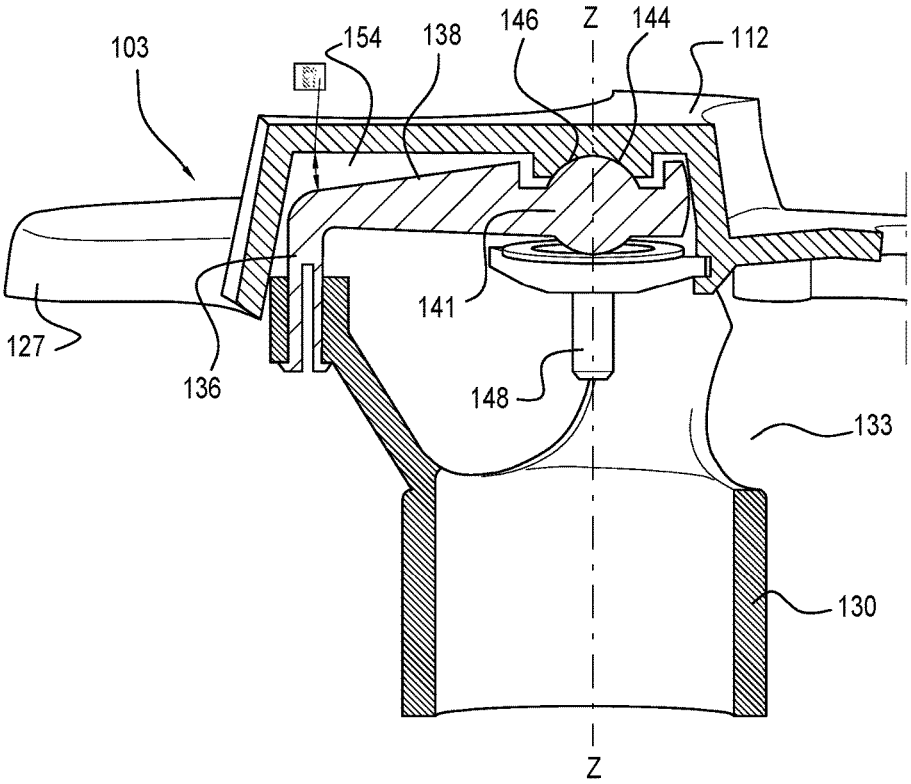
FIG. 5 shows a partially sectioned perspective view of a second embodiment of a shaving head according to the present invention.

A shaving head 103 according to a second embodiment of the invention is shown in a partially sectioned perspective view in FIG. 5. Similar elements to the first embodiment are provided with similar reference numerals increased by 100. According to FIG. 5, the shaving head 103 comprises a shaving unit frame 127 and a support structure 133 comprising a support tube 130 and a pivot frame 136. In this embodiment, the pivot frame 136 has a central portion 141 with a bearing ball 144. The shaving unit frame 127 is generally identical to the first embodiment and differs only in that a bearing socket 146 is provided at the centre of the underside of the shaving unit frame 127 at the position where the channels 154 intersect. The bearing ball 144 and the bearing socket 146 interengage to form a pivot structure allowing the shaving unit frame 127 to pivot relative to the support structure 133 about any axis lying parallel to the plane of the skin contacting face 112.

Like in the case of the first embodiment, the lateral arms 138 are located within the channels 154. As a consequence of this form-fit structure, rotation of the shaving unit frame 127 with respect to the support structure 133 around the Z axis is prevented. Furthermore, rocking or pivoting of the shaving unit frame 127 around the bearing ball 144 is limited to the angle $\alpha$ corresponding to the angular clearance between the lateral arms 138 and the channels 154. The shaving unit frame 127 includes an axle 148, extending downwards below the bearing ball 144, which acts as a bearing on which a central driving member (not shown) is mounted for rotation.

The skilled person will be aware that many alternative configurations may be envisaged for the pivot structure. In particular, the bearing ball 144 and bearing socket 146 may be exchanged for a Cardan-type universal coupling having orthogonal axes, coupled between the shaving unit frame 127 and the pivot frame 136. Alternatively, a living hinge or suitable flexible element could join the shaving unit frame 127 to the pivot frame 136 at this point. In the case of a head with just two cutting units, only a single pivoting direction may be required and a cylindrical or barrel surface may be used instead of the spherical bearing surfaces of the bearing ball 144 and bearing socket 146.

Figure 6:
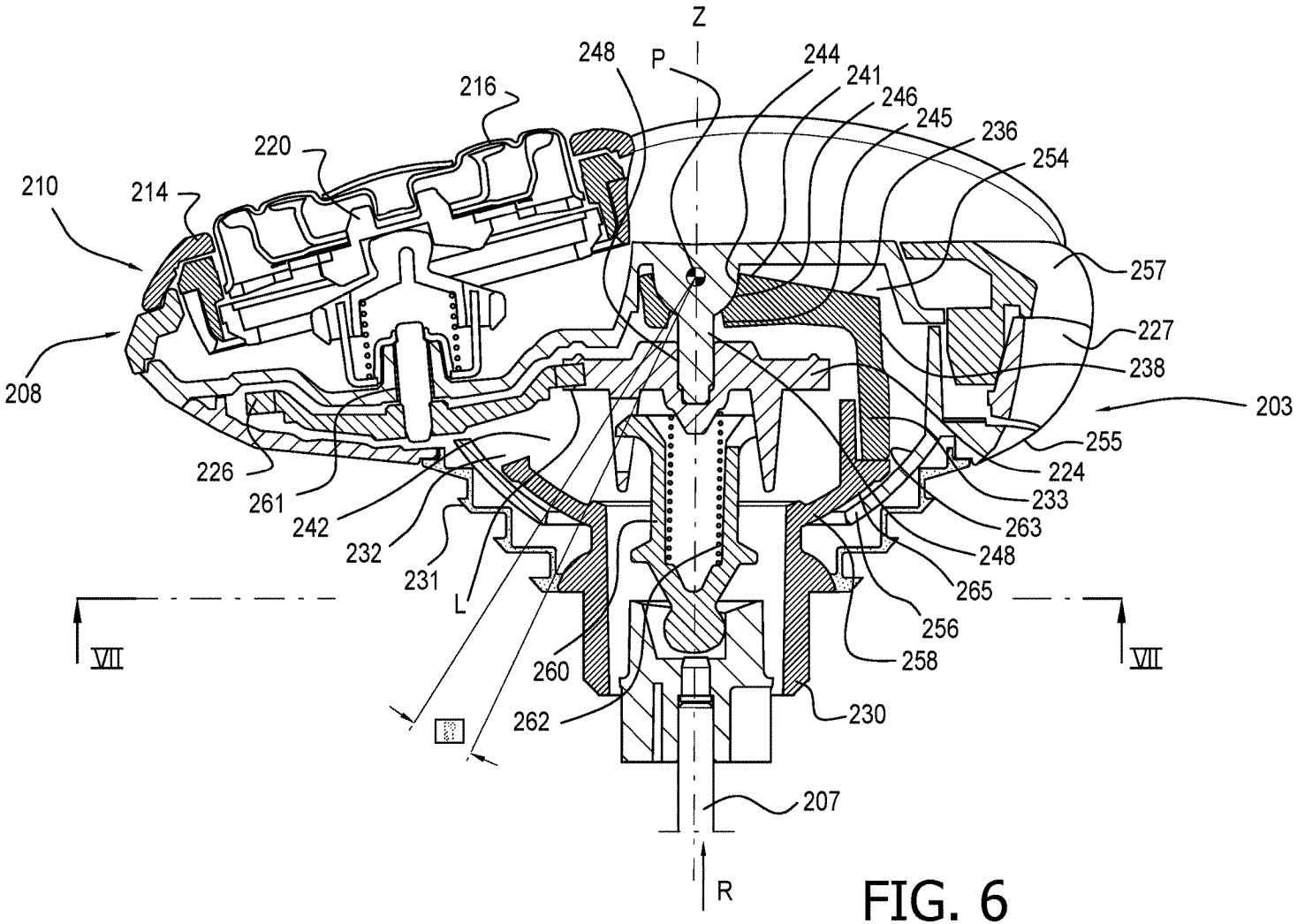
FIG. 6 shows a partially sectioned perspective view of a third embodiment of a shaving head according to the present invention.

FIG. 6 shows a shaving head 203 according to a third and most preferred embodiment of the invention in a partially sectioned perspective view. Similar elements to the first embodiment are provided with similar reference numerals increased by 200. Elements not relevant to an understanding of the invention have been omitted in this view.

According to FIG. 6, the shaving head 203 has a support structure 233 pivotably connected to a shaving unit 208 in which cutting units 210 are located. Each cutting unit 210 comprises an external cutting member 216 and an internal cutting member 220 carried in a pivotable carrier 214, with the internal cutting member 220 being engaged by a cutter driving member 226. The support structure 233 comprises a support tube 230 and a pivot frame 236 having a central portion 241 with a spherical socket 244 facing upwards. The spherical socket 244 has an opening 245 through its base facing the interior cavity 242 of the support structure 233. The opening 245 flares outwards at its lower extremity as will be explained in further detail below.

The shaving unit 208 has a shaving unit frame 227, which also differs from the first embodiment in that a spherical boss 246 is provided at the centre of its underside at the position where channels 254 intersect. The spherical boss 246 carries an axle 248 that extends from its lower extremity. In the assembled position, the spherical boss 246 seats in the spherical socket 244, forming a pivot structure allowing the shaving unit 208 to pivot relative to the support structure 233, with the axle 248 extending from the shaving unit frame 227 downwards through the opening 245 and the central portion 241. A central driving member 224 is mounted for rotation on the axle 248 within the interior cavity 242 and engages with cutter driving members 226 through lateral openings 232 between the lateral arms 238 at transmission locations L. The cutter driving members 226 each have a cutter bearing 261 carried by the shaving unit frame 227. In the embodiment of FIG. 6, the shaving unit frame 227 includes a shaving unit lower housing portion 255 and a shaving unit upper housing portion 257. The shaving unit lower housing portion 255 has a spherical inner surface 263 and a lower rim 256. Support tube 230 has an upper rim 258 with a matching outer surface portion 265 that engages with the spherical inner surface 263 of the lower rim 256 so as to be a sliding fit.

Like in the earlier embodiments, the lateral arms 238 are located within the channels 254. As a consequence of this form-fit structure, rotation of the shaving unit frame 227 with respect to the support structure 233 around the Z axis is prevented. Rocking or pivoting of the spherical boss 246 in the spherical socket 244 is permitted due to the angular clearance between the lateral arms 238 and the channels 254 and also due to the clearance between the axle 248 and the opening 245.

According to an advantage of the third embodiment, the lower rim 256 is arranged at a distance from the support tube 230 such that the pivoting movement of the shaving unit frame 227 is limited to an angle $\alpha$ which in this case is defined by the angular distance from the neutral position to a point at which abutment between the lower rim 256 and support tube 230 occurs. These components may be manufactured robustly compared to the axle 248 and the lateral arms 238. In the event that the shaving apparatus is dropped, the impact of a blow on the shaving head 203 is likely to cause the shaving unit 208 to pivot about the support structure 233 to the maximum extent possible. This rotation is arrested by abutment of the lower rim 256 with the support tube 230, whereby damage to the lateral arms 238 may be prevented.

According to FIG. 6, it will be understood that when the shaving unit 208 is pivoted with respect to the support tube 230, the axle 248 carrying the central driving member 224 is displaced laterally with respect to the Z axis, within the interior cavity 242 of the support tube 230. A central coupling spindle 260 is brought into engagement with the drive shaft 207 by a Visman coupling as described above and can also pivot with respect to it, while transferring torque. The central coupling spindle 260 is resiliently mounted under the bias of central coupling spring 262 which presses on the central driving member 224. The central coupling spring 262 also biases the shaving unit 208 upwards with respect to the housing of the shaving apparatus and the support tube 230. This causes the spherically shaped lower rim 256 to engage against the upper rim 258 of the support tube 230.

During use, the reaction force R provided by the user against the skin acts against the bias of the central coupling spring 262, causing the spherical inner surface 263 and the matching outer surface portion 265 to separate, thus reducing the friction between these surfaces. The pivoting movement of the shaving unit 208 is resisted only by the friction within the spherical socket 244. It has been found that due to the optimised location of the pivot point P and the reduced friction, a significantly reduced rigidity of bellows 231 may be used, allowing an extremely light shaving action.

Figure 7:
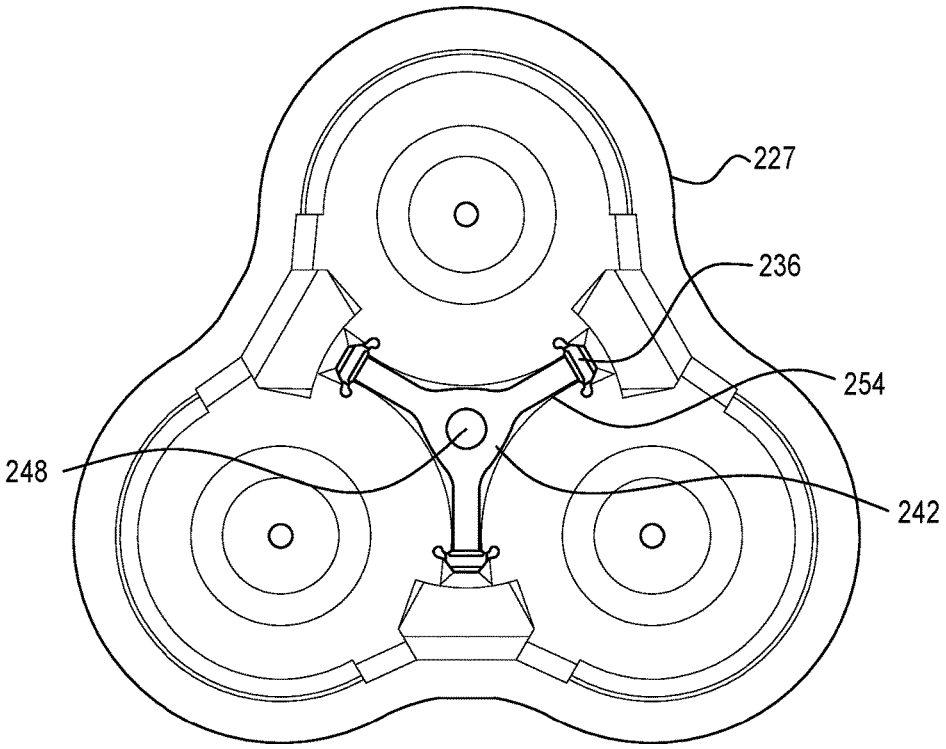
FIG. 7 shows a view of the underside of the shaving unit frame of FIG. 6 in the direction of the arrows VII in FIG. 6.

FIG. 7 shows a view of the underside of the shaving unit frame 227 from which the support tube 230 and the lower housing portion 255 have been removed. As can be seen in this view, the pivot frame 236 seats snugly within the channels 254 of the shaving unit frame 227. The central portion 242 also has a triangular shape, with the axle 248 extending therethrough.

Figure 8:
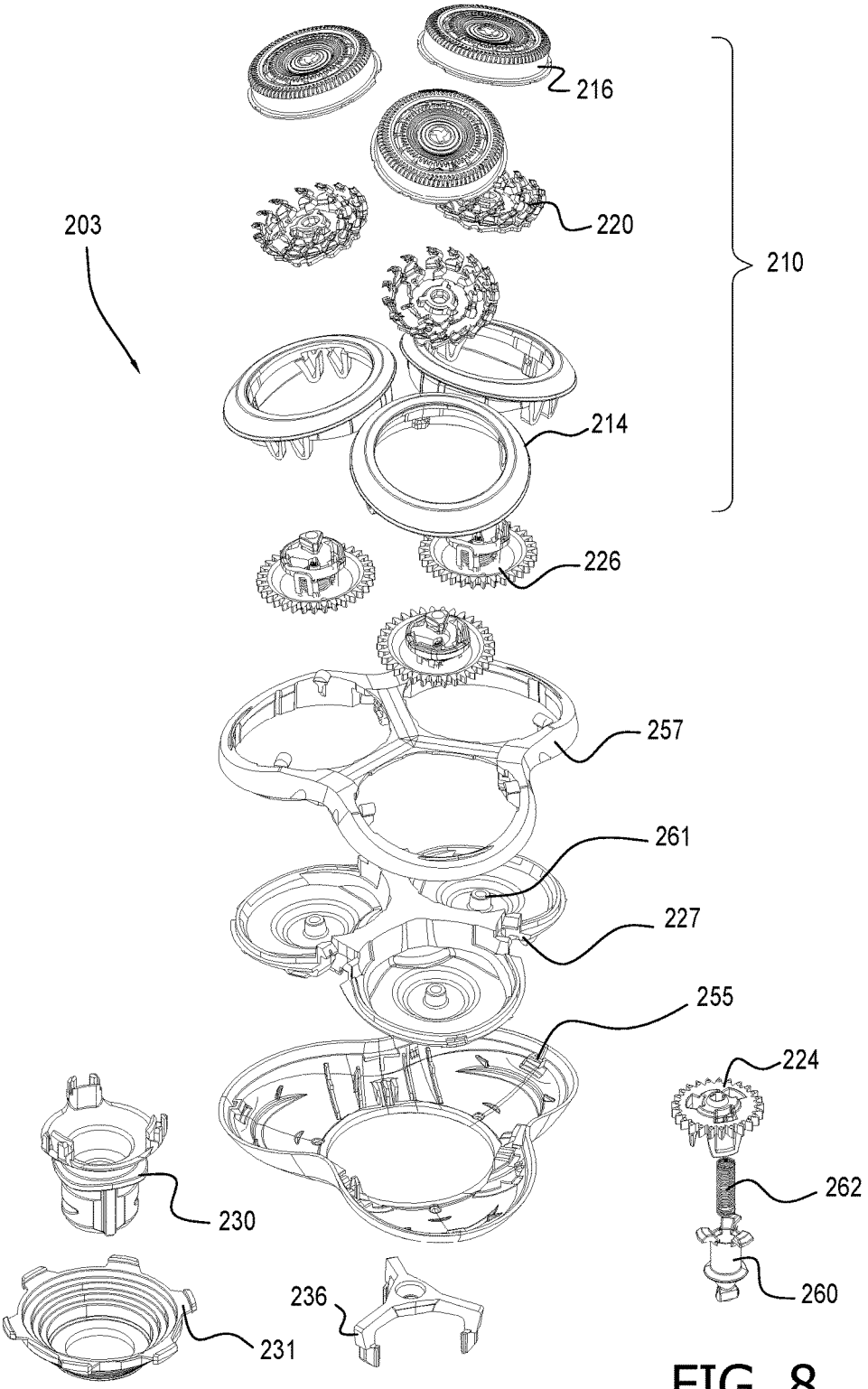
FIG. 8 shows an exploded perspective view of the shaving head of FIG. 6 including all of the components.

FIG. 8 shows an exploded perspective view of the shaving head 203 according to the third embodiment, including all the components. From top to bottom, these include external cutting members 216, internal cutting members 220 and carriers 214 forming the cutting units 210, cutter driving members 226, shaving unit upper housing portion 257, shaving unit frame 227, shaving unit lower housing portion 255, pivot frame 236 including cutter bearings 261, support tube 230, bellows 231, central driving member 224, central coupling spring 262 and central coupling spindle 260.

Thus, the invention has been described with reference to certain embodiments discussed above. It will be recognized that these embodiments are susceptible to various modifications and alternative forms well known to those of skill in the art. In particular, the three-unit shaving heads may be replaced by shaving heads with two cutting units or more than three cutting units.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A shaving head for a shaving apparatus that includes a main housing accommodating a motor, the shaving head comprising:

a support structure that comprises a coupling structure configured for coupling the shaving head to the main housing of the shaving apparatus;

a shaving unit that comprises a shaving unit frame, a skin contacting face, and at least two cutting units, wherein each cutting unit comprises an external cutting member and an internal cutting member, and wherein each internal cutting member is rotatable relative to a respective external cutting member;

a pivot structure that comprises a first bearing portion of the support structure configured to be inter-engaged with a second bearing portion of the shaving unit, the pivot structure for allowing the shaving unit to pivot relative to the support structure; and a central driving member arranged to be driven by the motor in response to the shaving head being coupled to the main housing;

wherein each of the internal cutting members of the at least two cutting units is rotatable by the central driving member via a separate cutter driving member, wherein the central driving member is configured to transmit a driving force to each separate cutter driving member in a respective separate transmission location, wherein the pivot structure is located in an internal area of the shaving head located between the skin contacting face, the separate cutter driving members and the separate transmission locations of the central driving member, and wherein the central driving member and the cutter driving members are each coupled to the shaving unit frame via a respective bearing, further wherein the pivot structure is configured to allow the central driving member and the cutter driving members to pivot together with the shaving unit relative to the support structure.

2. The shaving head according to claim 1, wherein the bearing of the central driving member comprises an axle extending from the shaving unit frame in a direction away from the skin contacting face, and the central driving member is mounted for rotation on the axle.

3. The shaving head according to claim 1, wherein the shaving unit is pivotable relative to the support structure about a pivot point of the pivot structure, wherein the pivot point is distanced from the skin contacting face by less than 12 mm.

4. The shaving head according to claim 1, further comprising a resilient biasing arrangement acting on the shaving unit frame of the shaving unit, between the shaving unit frame and the support structure, to bias the shaving unit to a neutral position with respect to the support structure.

5. The shaving head according to claim 4, wherein the resilient biasing arrangement comprises a flexible bellows structure encircling the support structure and acting between the shaving unit frame and the support structure.

6. The shaving head according to claim 1, wherein the first bearing portion and the second bearing portion of the pivot structure comprise cooperating spherical bearing surfaces provided on the support structure and on the shaving unit, respectively, and arranged in said internal area of the shaving head to allow pivoting of the shaving unit about any axis parallel to the skin contacting face.

7. The shaving head according to claim 1, wherein the first bearing portion and the second bearing portion of the pivot structure comprise cooperating bearing surface portions of a coupling element having a triangular cross-section or any other non-circular cross-section and arranged in said internal area of the shaving head.

8. The shaving head according to claim 1, wherein the first bearing portion and the second bearing portion of the pivot structure comprise cooperating portions of a living hinge formed between the support structure and the shaving unit frame and arranged in said internal area of the shaving head.

9. The shaving head according to claim 1, wherein the shaving unit comprises two cutting units, and wherein the first bearing portion and the second bearing portion of the pivot structure comprise cooperating cylindrical bearing surfaces provided on the support structure and on the shaving unit, respectively, and arranged in said internal area of the shaving head to allow pivoting of the shaving unit about just one axis.

10. The shaving head according to claim 1, wherein the support structure and the shaving unit frame include lateral-arm and channel shapes of a form-fit structure configured to prevent rotation of the shaving unit about a Z axis of the support structure, while allowing the shaving unit to pivot relative to the support structure about an X-axis and Y-axis of the support structure.

11. The shaving head according to claim 1, wherein the support structure comprises (i) a support tube that includes the coupling structure, and (ii) a pivot frame mounted to the support tube, wherein the pivot frame includes the first bearing portion and comprises a stationary part of the pivot structure.

12. The shaving head according to claim 11, wherein the pivot frame mounted to the support tube includes lateral openings formed between the pivot frame and support tube, and wherein the central driving members operatively engages with each cutter driving member through a respective one of the lateral openings.

13. The shaving head according to claim 12, wherein the pivot frame comprises a central portion carrying the stationary part of the pivot structure, wherein said central portion is connected to the support tube via lateral arms, and wherein the lateral openings are present between the lateral arms.

14. The shaving head according to claim 13, wherein the bearing of the central driving member comprises an axle extending from the shaving unit frame and through the central portion of the pivot frame in a direction away from the skin contacting face, and the central driving member is mounted for rotation on the axle.

15. The shaving head according to claim 1, wherein the shaving unit comprises a lower housing portion having a spherical inner surface surrounding the support structure and engaging a matching outer surface portion of the support structure.

16. The shaving head according to claim 15, wherein the lower housing portion of the shaving unit comprises an abutment for engaging an abutment provided on the support structure to prevent pivoting of the shaving unit relative to the support structure beyond a given angle.

17. The shaving head according to claim 1, wherein the shaving unit is pivotable relative to the support structure about a pivot point of the pivot structure, wherein the pivot point is distanced from the skin contacting face by less than 10 mm.

18. The shaving head according to claim 1, wherein the shaving unit is pivotable relative to the support structure about a pivot point of the pivot structure, wherein the pivot point is distanced from the skin contacting face by less than 8 mm.

19. A shaving apparatus comprising a main housing and a shaving head according to claim 1.

* * * * *